US005945247A

United States Patent [19]

Shimada

[11] Patent Number: 5,945,247

[45] Date of Patent: Aug. 31, 1999

[54] HEAT DEVELOPMENT DUPLICATING MATERIAL COMPRISING ASCORBIC ACID

[75] Inventor: Hirokazu Shimada, Shizuoka, Japan

[73] Assignee: Fuji Photo Film Co., Ltd., Kanagawa, Japan

[21] Appl. No.: 08/838,291

[22] Filed: Apr. 17, 1997

[30] Foreign Application Priority Data

Apr. 18, 1996 [JP] Japan ..... 8-096885

[51] Int. Cl.[6] ..... G03C 1/61; G03C 1/72

[52] U.S. Cl. ..... 430/138; 430/157; 430/170; 430/171; 430/177

[58] Field of Search ..... 430/138, 157, 430/170, 171, 177

[56] References Cited

U.S. PATENT DOCUMENTS 3,620,740 11/1971 Poot ..... 430/138

4,511,642 4/1985 Higashi et al. ..... 430/177

5,679,494 10/1997 Minami et al. ..... 430/138

FOREIGN PATENT DOCUMENTS 59-91438 5/1984 Japan ..... G03C 1/68

*Primary Examiner*—John S. Chu

*Attorney, Agent, or Firm*—Sughrue, Mion, Zinn, Macpeak & Seas, PLLC

[57] ABSTRACT

A heat development type duplicating material having a recording layer which is formed on a support. The recording layer comprises a photosensitive diazo compound and a coupler that reacts with the diazo compound to develop color. Furthermore, the duplicating material contains an ascorbic acid derivative. The heat development type duplicating material generates little stain in background areas, exhibits satisfactory storage stability, and provides a high image density.

11 Claims, No Drawings

HEAT DEVELOPMENT DUPLICATING MATERIAL COMPRISING ASCORBIC ACID

FIELD OF THE INVENTION

The present invention relates to a heat development type duplicating material comprising a photosensitive diazo compound, and more particularly, to a heat development type duplicating material having improved background storage stability.

BACKGROUND OF THE INVENTION

Duplicating materials which utilize the photosensitivity of diazo compounds are common because they are inexpensive. Such materials can be classified into three main groups as follows.

The first is known as a wet development type duplicating material in which a photosensitive layer comprising a diazo compound and a coupler as main components is provided on a support. In this technique, an original is superposed on the material, exposed to light, and then developed using an alkaline solution.

The second is known as a dry development type duplicating material which differs from a wet development type in that ammonia gas is used for development instead of an alkaline solution.

The third is known as a heat development type duplicating material, which includes those materials containing an ammonia gas generator in a photosensitive layer such as urea that generates ammonia on heating, and in addition, those materials containing an alkali salt of a compound in the photosensitive layer such as trichloroacetic acid that loses its acidic properties on heating. Also known is a heat development type duplicating material containing a higher fatty acid amide as an coloring aid that melts on heating to facilitate the reaction between the diazo compound and the coupler.

The wet development type duplicating material is disadvantageous in that replenishment of the developing solution and disposal of the waste solution therefrom are undesirable. Also, this type of duplicating material involves troublesome maintenance and management due to the need for a relatively large apparatus. Additionally, it is difficult to retouch the material which is wet with the developing solution immediately after copying. Also, the copied images have poor durability upon long-term storage.

The dry development type duplicating material also is disadvantageous in that it requires, similarly to a wet development type material, replenishment of a developing solution, a gas-absorbing system for protecting the working atmosphere from ammonia gas that is generated in the development process and, consequently, a large apparatus. Furthermore, a strong odor of ammonia gas proliferates immediately after copying.

In contrast to these wet and dry development type duplicating materials, the heat development type duplicating material offers the advantage of easy maintenance because a developing solution is not used. However, the developing temperature thereof is as high as 150° C. to 200° C., and in addition, the temperature must be maintained with accuracy within ±10° C. in order to avoid underdevelopment or changes in color tone. Therefore, to assure satisfactory images, the development apparatus is expensive. Furthermore, to endure such high developing temperatures, the diazo compounds used therein must have a greater heat resistance. However, such diazo compounds having a greater heat resistance are generally disadvantageous in obtaining high image density.

A number of proposals have been made to develop the material at lower temperatures (from 90° C. to 130° C.). However, these materials have a poor shelf life. Accordingly, a heat development type duplicating material is still not widely used in a diazo duplicating system, in spite of the advantage thereof in maintenance which is fully expected as compared with wet and dry development type materials.

On the other hand, the demand for the duplicating materials has increasingly diversified. For example, in addition to conventional materials which form a color image on a white background area, there is also a need for selecting a color tone for both the image and background areas depending on the intended application. This is because drawings and notices which are prepared from conventional monotonous duplicating materials fail to attract the viewer's attention.

In order to obtain the desired color density by heating a material having a layer which is formed on a support and which comprises a diazo compound, a coupler and a coloring aid, the respective components on heating must rapidly fuse, diffuse, and react to form a color dye. When a material is designed so that an image can provide a sufficiently high density even by a low heat temperature, as a matter of course, the coloring reaction proceeds to some extent in the material even during a storage at room temperature to stain (color) the background area which is intrinsically white.

In a heat development type duplicating material having a photosensitive layer provided on a support and which comprises a diazo compound, a coupler and a coloring aid, the above described problem of background staining which become remarkable when the material is designed to provide a sufficiently high color density even by a low heat temperature has nearly been solved by encapsulating the diazo compound in a microcapsule (JP-A-59-91438; The term "JP-A" as used herein means an "unexamined published Japanese patent application").

Even in this case, however, those duplicating materials which are designed to provide high image densities still suffer from insufficient shelf life.

SUMMARY OF THE INVENTION

Therefore, an object of the present invention is to provide a heat development type duplicating material which generates little background stain, has improved storage stability as compared to conventional materials, and which can provide a high image density as well.

The above object have been achieved by providing a heat development type duplicating material comprising a support having thereon a recording layer which comprises a photosensitive diazo compound and a coupler that reacts with the diazo compound to develop a color, wherein the duplicating material further comprises an ascorbic acid derivative represented by the following general formula:

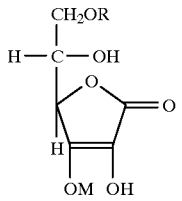

wherein R represents a hydrogen atom, an alkyl group, or an alkylcarbonyl group; and M represents a hydrogen atom or an alkali metal atom.

In a preferred embodiment, the ascorbic acid derivative is present in the recording layer.

DETAILED DESCRIPTION OF THE INVENTION

The alkyl group represented by R preferably has from 1 to 20 carbon atoms, and particularly preferably from 1 to 10 carbon atoms. The alkylcarbonyl group represented by R preferably has from 2 to 20 carbon atoms. Both the alkyl group and the alkylcarbonyl group may further be substituted by a substituent group. Preferred examples of the substituent group include a hydroxy group, a lower alkoxy group having from 1 to 5 carbon atoms, —CO—R' (where R' is a hydroxy-group, a lower alkoxy group having from 1 to 5 carbon atoms, or an amino group), and —OCO—R" (where R" is a lower alkoxy group having from 1 to 5 carbon atoms, or an amino group). Of these, a hydroxy group and lower alkoxy groups are particularly preferred. Examples of the ascorbic acid derivative represented by the above general formula are compounds (1) to (3) described below. Of these, compound (1) is particularly preferred.

Compound (1)

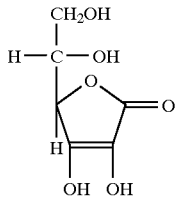

Compound (2)

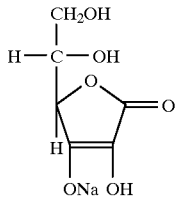

Compound (3)

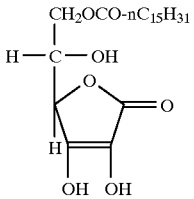

The duplicating material preferably contains the above described ascorbic acid derivative in an amount of from 0.001 to 0.1 g/m$^2$. Usually, an amount of less than 0.001 g/m$^2$ fails to improve the storage stability of the background areas, whereas an amount of exceeding 0.1 g/m$^2$ reduces heat sensitivity.

The photosensitive diazo compound for use in the present invention can be appropriately selected from among known diazo compounds such as photolytic diazonium salts, diazo sulfonates, and diazoamino compounds which simultaneously have two functions, that is, those which breakdown upon exposure to light and those which react with a coupler to develop color.

Among these diazo compounds, diazonium salts represented by the general formula $ArN_2^+X^-$ are preferred in view of their light sensitivity and ability to form images having a high image density (wherein Ar represents a substituted or unsubstituted aromatic moiety; $N_2^+$ represents a diazonium group; and $X^-$ represents an acid anion).

Examples of such diazonium salts include 4-diazo-1-dimethylaminobenzene, 4-diazo-1-diethylaminobenzene, 4-diazo-1-dipropylaminobenzene, 4-diazo-1-methylbenzylaminobezene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-toluylmercapto-2,5-diethoxybenzene, and 4-diazo-1-(4-methoxy) benzoylamino-2,5-diethoxybenzene.

Examples of the acids constituting these diazonium salts include $C_nF_{2n+1}COOH$ (where n represents an integer of from 1 to 9), $C_mF_{2m+1}SO_3H$ (where m represents an integer of from 1 to 9), boron tetrafluoride, tetraphenylboron, hexafluorophosphoric acid, aromatic carboxylic acid, and metal halides such as zinc chloride and tin chloride.

In the present invention, the photosensitive diazo compounds can be used in the form of solid dispersions or emulsified dispersions, or can be microencapsulated. Although the form of the compounds is not particularly limited, microencapsulation is preferred.

Couplers for use in the present invention are those which undergo a coupling reaction with the diazo compound on heating to form a dye. Examples of the couplers include resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanilnaphthalene, 2-hydroxy-3-naphthoic acid morpholinopropylamide, 2-hydroxy-3-naphthoic acid anilide, 2-hydroxy-3-naphthoic acid 2'-methylanilide, 2-hydroxy-3-naphthoic acid ethanolamide, 2-hydroxy-3-naphthoic acid octylamide, 2-hydroxy-3-naphthoic acid N-dodecyl-oxy-propylamide, 2-hydroxy-3-naphthoic acid tetradecylamide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone, and 1-phenyl-3-phenylacetamido-5-pyrazolone.

Two or more couplers can also be employed together to form an image having an arbitrary color tone.

In the present invention, a basic substance is preferably added to the recording layer as a coloring aid as needed in order to promote the coupling reaction by changing the system to a basic state upon heat development. Basic substances which are sparingly soluble or insoluble in water, or substances which produce alkaline substances on heating can be employed as the basic substance.

Basic substances for use in the present invention include nitrogen-containing compounds such as inorganic and organic ammonium salts, organic amines, amides, and urea, thiourea and the derivatives thereof, thiazoles, pyrroles, pyrimidines, piperazines, guanidines, indoles, imidazoles, imidazolines, triazoles, morpholines, piperidines, amidines, formamidines, and pyridines. The basic substance can be employed as a mixture of two or more kinds thereof.

Particularly, in order to obtain high heat sensitivity, the following compounds can be incorporated into the recording layer: fatty acid amides, N-substituted fatty acid amides, phenol derivatives, naphthol derivatives, alkoxy-substituted benzenes, alkoxy-substituted naphthalenes, hydroxy compounds, acido compounds, sulfonamido compounds, ketone compounds, urea compounds, and esters. These compounds lower the melting points of the couplers or basic substances or improve heat permeability of the microcapsule wall. That is, they act as heat sensitizers, and also include heat-fusible substances. The term "heat-fusible substances" as used herein means substances which are solid at ordinary temperature and melt at 50 to 150° C. to dissolve the diazo compounds, the couplers, or the basic substances.

In the present invention, the couplers and the coloring aids are preferably used in an amount of from 0.1 to 10 parts by weight and from 0.1 to 20 parts by weight, respectively, per one part by weight of the diazo compound, with the proviso that the diazo compound is preferably applied in an amount of from 0.05 to 5.0 g/m$^2$.

To prepare the microcapsule for use in the present invention, a core substance is emulsified followed by forming a wall of a polymeric substance around the oil droplets. The reactant from which the polymeric substance is formed is incorporated into the inside and/or outside of the oil droplets. Examples of the polymeric substance include polyurethane, polyurea, polyamide, polyester, polycarbonate, urea-formaldehyde resin, and melamine resin.

Two or more kinds of these polymeric substances can also be used at the same time. Of these, polyurethane, polyurea, polyamide, polyester, and polycarbonate are preferred, and polyurethane and polyurea are more preferred. The polyurethane and polyurea are preferably a trimethylolpropane adduct of tolylenediisocyanate, an isocyanurate derivative of tolylenediisocyanate, a trimethylolpropane adduct of xylylenediisocyanate, an isocyanurate derivative of xylylenediisocyanate, and an isocyanurate derivative of hydrogen added-xylylenediisocyanate.

The polymeric substance preferably has a melting point of 150° C. or higher so as not to melt at heat-recording temperatures.

The microcapsule can be prepared from an emulsion containing 0.2% by weight or more of the component to be microencapsulated.

The microcapsule for use in the present invention preferably does not substantially contain a solvent. To prepare such a microcapsule, for example, a diazo compound and a coupler are dissolved in a low boiling nonaqueous solvent together with a capsule wall-forming monomer followed by removing the solvent while polymerizing the monomer.

When the polymers from which the microcapsule wall is formed are prepared from the monomers according to the procedure described above, the monomers are generally used in an amount needed to provide a microcapsule having an average diameter of from 0.3 to 12 $\mu$m. The microcapsule thus prepared prevents the diazo compounds from contacting the couplers at ordinary temperature as compared with conventional materials.

In the present invention, the couplers, the basic substances, and the coloring aids such as heat sensitizers which are not placed in the microcapsule are solid dispersed together with water-soluble polymers using a sand mill, etc. The water-soluble polymers preferably include those which are used for preparing the microcapsule (for example, see JP-A-59-190886). In this case, the couplers and the coloring aids such as heat sensitizers are preferably added in an amount of from 10 to 60% by weight, respectively, based on the weight of the water-soluble polymer solution. The dispersed particle size is preferably 10 $\mu$m or less.

When there is a need to make the recording layer substantially transparent, the above-mentioned components are dissolved in an organic solvent which is sparing soluble or insoluble in water, mixed with an aqueous solution of a surfactant and the water-soluble polymer that acts as a protective colloid, and the resulting mixture is dispersed.

The dispersion thus prepared can be applied according to widely known procedures such as bar coating, blade coating, air knife coating, gravure coating, doctor coating, slide coating, roll coating, spray coating, dip coating, and curtain coating and, in addition, the procedure described in Yuji Harazaki, *Coating Engineering*, Asakura Shoten, 1973, p. 253.

The recording layer (also referred to as a "photosensitive layer") of the present invention is applied so that the amount of the solid components is from 1.5 to 15 g/m$^2$ on a dry weight basis.

In the duplicating materials of the present invention, the diazo compounds, the couplers, the basic substances, and other compounds may be contained in a single layer or in a plurality of layers which form a multilayer type structure. It also is possible to provide an interlayer as described in JP-A-61-54980 on the support and to subsequently form a photosensitive layer on the interlayer. A protective layer can also be provided on the photosensitive layer.

For forming an image on the duplicating material of the present invention, the material is imagewise exposed in correspondence with an original to decompose the diazo compound in the exposed areas. Then, the entire material is heated to allow the diazo compound remaining in the unexposed areas to react with the coupler, to thereby obtain a color image.

When the original is transparent, the imagewise exposure corresponding to the original is readily carried out by contact exposure. In addition, laser rays can also be used to expose the duplicating material, e.g., in a scanning exposure.

Light sources for exposure include various fluorescent lamps, xenon lamps, mercury vapor lamps, and the like. The emission spectrum of the light source used for exposure desirably substantially overlaps with the absorption spectrum of the diazo compound contained in the recording layer.

The heat development is carried out by heating the entire photosensitive layer of the duplicating material. Infrared rays, high-frequency waves, heat blocks, heat rollers, or the like can be used as the heating means.

As described above, the heat development type recording material of the present invention which contains an ascorbic acid derivative exhibits satisfactory storage stability in the background areas.

The present invention is illustrated below by means of the following Examples. However, the present invention should not be construed as being limited thereto. The term "part" which is used below as an unit of content means "part by weight".

EXAMPLE 1

Preparation of Microcapsule Solution

Two parts of a diazonium salt represented by the following formula (4), one part of a compound represented by formula (5), and one part of a compound represented by formula (6) were dissolved in five parts of ethyl acetate.

Formula (4)

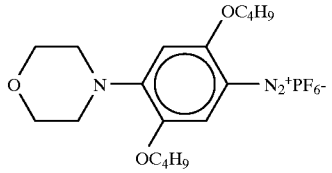

Formula (5)

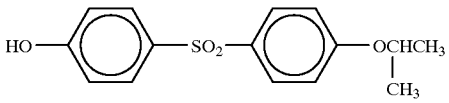

Formula (6)

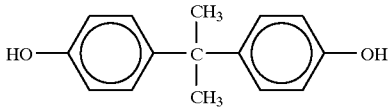

Three parts of an isocyanate having a structure of an isocyanurate derivative of tolylenediisocyanate (Sumidur FL-2: trade name, manufactured by Sumitomo Bayer Urethane Co., Ltd.) and three parts of an isocyanate having a structure of a trimethylolpropane adduct of xylylenediisocyanate (Takenate D-110N: trade name, manufactured by Takeda Chemical Industries, Ltd.) were added to the above solution of the diazonium salt and other compounds, and mixed with stirring.

The thus prepared ethyl acetate solution of the diazonium salt, the isocyanates and compounds represented by formulae (5) and (6) was mixed with an aqueous solution in which one part of polyvinyl alcohol (PVA217E: manufactured by Kuraray Co., Ltd.) was dissolved in 10 parts of water, and then dispersed to obtain an emulsion containing particles having an average size of 1.0 $\mu$m. The emulsion, to which ten parts of water were added, was maintained at 40° C. with stirring for three hours to allow the isocyanates and wall-forming substances to react. As a result, a microcapsule having an average particle size of 1 $\mu$m was obtained containing the diazo compound and compounds represented by formulae (5) and (6) as core substances. This encapsulation was performed under a reduced pressure of 400 to 500 mmHg with the aid of a water jet pump.

Preparation of Coupler Dispersion

Five parts of 2-hydroxy-3-naphthoic acid anilide and five parts of triphenylguanidine were added to 100 parts of a 5% by weight aqueous solution of polyvinyl alcohol, and then dispersed with a sand mill for 24 hours to obtain a dispersion having an average particle size of 2 $\mu$m.

Preparation of Coating Solution

A solution for coating was prepared by mixing ten parts of the solution of the microencapsulated diazonium salt obtained above, 25 parts of the coupler dispersion thus prepared, ten parts of a 40% by weight dispersion of calcium carbonate (Unibur 70: manufactured by Shiraishi Industries, Ltd.), five parts of a 20% by weight dispersion of stearic acid amide, two parts of a 40% by weight dispersion of zinc 3,5-di($\alpha$-methylbenzyl)salicylate, and one part of a 5% by weight solution of L-ascorbic acid represented by compound (1) (Vitamin C: Takeda Chemical Industries, Ltd.).

Preparation of Duplicating Material

The solution for coating thus prepared was applied to smooth wood free paper (76 g/m$^2$) using a coating bar so as to have a coverage of 5 g/m$^2$ on a dry weight basis (the diazo compound: 0.2 g/m$^2$, L-ascorbic acid: 0.02 g/m$^2$), and then dried at 50° C. for three minutes to obtain a duplicating material of the present invention.

Evaluation of Heat Sensitivity

After the duplicating material thus prepared was image-wise exposed, the material was pressed against a heat block heated to 100° C. for 2.5 seconds to develop an image. The densities of image areas were measured with a Macbeth densitometer. The results are shown in Table 1.

Evaluation of Storage Stability

For evaluating the storage stability (shelf life), the recording material was subjected to a forced deterioration test in which the material was stored in the dark for one day at 40° C.-90% RH and at 60° C.-30% RH. The densities of the background areas were measured with a Macbeth densitometer before and after storage.

EXAMPLE 2

A solution for coating and a duplicating material were successively prepared in the same manner as described in Example 1, except that the L-ascorbic acid used in Example 1 was replaced by sodium L-ascorbate represented by compound (2). The storage stability of the material thus obtained was then evaluated in the same manner as in Example 1.

EXAMPLE 3

A solution for coating and a duplicating material were successively prepared in the same manner as described in Example 1, except that the L-ascorbic acid used in Example 1 was replaced by compound (3). The storage stability of the material thus obtained was then evaluated in the same manner as in Example 1.

EXAMPLE 4

A solution for coating and a duplicating material were successively prepared in the same manner as described in Example 1, except that three parts of a 5% by weight aqueous solution of L-ascorbic acid were used in place of one part of the same solution as used in Example 1. The storage stability of the material thus obtained was then evaluated in the same manner as in Example 1.

COMPARATIVE EXAMPLE 2

A solution for coating and a duplicating material were successively prepared in the same manner as described in Example 1, except that six parts of the aqueous solution of L-ascorbic acid were used in place of one part of the same solution as used in Example 1. The storage stability of the material thus obtained was then evaluated in the same manner as in Example 1.

COMPARATIVE EXAMPLE 1

A solution for coating and a duplicating material were successively prepared in the same manner as described in Example 1, except that L-ascorbic acid was not used at all. The storage stability of the material thus obtained was then evaluated in the same manner as in Example 1.

The results obtained in the above Examples and comparative Example are shown in Table 1 below.

In Table 1, o represents that the result is acceptable, and x represents that problem(s) was caused and thus the result is not acceptable for practical use.

TABLE 1

| | Color Image Area | | Background Area | | | |
|---|---|---|---|---|---|---|
| | | | Density | | | |
| | Density | Evaluation | Before Storage | After Storage for One Day at 40° C.-90% RH | After Storage for One Day at 60° C.-30% RH | Evaluation |
| Example 1 | 1.25 | ○ | 0.08 | 0.10 | 0.12 | ○ |
| Example 2 | 1.24 | ○ | 0.08 | 0.12 | 0.14 | ○ |
| Example 3 | 1.23 | ○ | 0.09 | 0.12 | 0.14 | ○ |
| Example 4 | 1.23 | ○ | 0.08 | 0.10 | 0.10 | ○ |
| Comparative Example 2 | 1.19 | ○ | 0.08 | 0.09 | 0.10 | ○ |
| Comparative Comparative Example 1 | 1.26 | ○ | 0.10 | 0.21 | 0.25 | X |

The results of Table 1 demonstrate that the present invention provides high image density as well as low background staining even under severe storage conditions. Furthermore, the results of Table 1 demonstrate that the material of comparative Example 1 not containing an ascorbic acid derivative is subject to much higher levels of background staining upon storage.

While the invention has been described in detail and with reference to specific examples thereof, it will be apparent to one skilled in the art that various changes and modifications can be made therein without departing from the spirit and scope thereof.

What is claimed is:

1. A heat developable duplicating material comprising a support having thereon a recording layer which comprises a photosensitive diazo compound and a coupler that reacts with the diazo compound to develop a color, wherein the duplicating material contains from 0.001 to 0.1 g/m$^2$ of an ascorbic acid derivative represented by the following general formula:

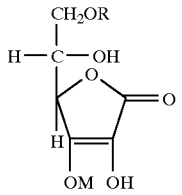

wherein R represents a hydrogen atom, an alkyl group or an alkylcarbonyl group; and M represents a hydrogen atom or an alkali metal atom.

2. The heat developable duplicating material as claimed in claim 1, wherein the photosensitive diazo compound is encapsulated in a microcapsule.

3. The heat developable duplicating material as claimed in claim 1, wherein said ascorbic acid derivative is present in the recording layer.

4. The heat developable duplicating material as claimed in claim 1, wherein the alkyl group represented by R has from 1 to 20 carbon atoms and the alkylcarbonyl group represented by R has from 2 to 20 carbon atoms.

5. The heat developable duplicating material as claimed in claim 1, wherein the alkyl or alkylcarbonyl group represented by R is substituted or unsubstituted.

6. The heat developable duplicating material as claimed in claim 1, wherein the ascorbic acid derivative comprises a compound selected from the group consisting of Compounds (1) to (3):

Compound (1)

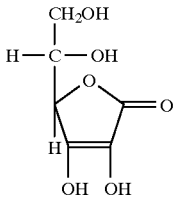

Compound (2)

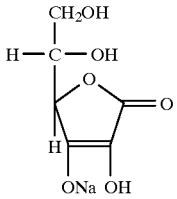

Compound (3)

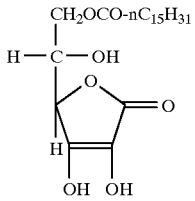

7. The heat developable duplicating material as claimed in claim 6, wherein the ascorbic acid derivative comprises Compound (1).

8. The heat developable duplicating material as claimed in claim 1, wherein said photosensitive diazo compound comprises a diazonium salt represented by the formula:

$$ArN_2^+X^-$$

where Ar is a substituted or unsubstituted aromatic moiety, $N_2^+$ is a diazonium group and $X^-$ is an acid anion.

9. The heat developable duplicating material as claimed in claim 1, wherein the recording layer further comprises a basic substance.

10. The heat developable duplicating material as claimed in claim 1, containing said coupler in an amount of from 0.1 to 10 parts by weight per one part by weight of the diazo compound.

11. The heat developable duplicating material as claimed in claim 1, wherein the photosensitive diazo compound is encapsulated in a microcapsule, the ascorbic acid derivative is present in the recording layer, and the ascorbic acid derivative and the coupler are arranged outside said microcapsule.

* * * * *